US009605894B2

(12) United States Patent
Christian

(10) Patent No.: US 9,605,894 B2
(45) Date of Patent: Mar. 28, 2017

(54) BUCKET ASSEMBLY FOR A BEVERAGE CONTAINER

(71) Applicant: Steven Christian, Houston, TX (US)

(72) Inventor: Steven Christian, Houston, TX (US)

( * ) Notice: Subject to any disclaimer, the term of this patent is extended or adjusted under 35 U.S.C. 154(b) by 213 days.

(21) Appl. No.: 14/222,594

(22) Filed: Mar. 22, 2014

(65) Prior Publication Data

US 2015/0267961 A1 Sep. 24, 2015

(51) Int. Cl.
*F25D 3/08* (2006.01)
*F25D 31/00* (2006.01)

(52) U.S. Cl.
CPC ..... *F25D 31/008* (2013.01); *F25D 3/08* (2013.01); *F25D 2303/0822* (2013.01); *F25D 2303/0841* (2013.01); *F25D 2303/0843* (2013.01); *F25D 2331/803* (2013.01); *F25D 2331/805* (2013.01); *F25D 2331/808* (2013.01); *F25D 2331/809* (2013.01); *F25D 2331/81* (2013.01)

(58) Field of Classification Search
CPC ..... F25D 2331/81; F25D 2331/805; F25D 2331/803; F25D 2331/809; F25D 31/008; F25D 3/08; F25D 2303/0822; F25D 2303/0843; F25D 2331/0808; F25D 2303/0841; F25D 31/07; F25D 2303/083; F25D 2303/0832; A47G 19/2288
See application file for complete search history.

(56) References Cited

U.S. PATENT DOCUMENTS

| | | | | | |
|---|---|---|---|---|---|
| 3,205,677 | A * | 9/1965 | Stoner | ..... | 62/457.3 |
| 4,399,668 | A * | 8/1983 | Williamson | ..... | 62/457.4 |
| 4,741,176 | A * | 5/1988 | Johnson et al. | ..... | 62/457.4 |
| 4,823,974 | A * | 4/1989 | Crosser | ..... | 62/457.3 |
| 5,352,502 | A * | 10/1994 | Fuller | ..... | 428/172 |
| 5,361,604 | A * | 11/1994 | Pier et al. | ..... | 62/457.4 |
| 5,415,305 | A * | 5/1995 | Drake-Tipton et al. | ..... | 215/392 |
| 5,960,984 | A * | 10/1999 | Weston | ..... | 220/739 |
| 6,116,045 | A * | 9/2000 | Hodosh et al. | ..... | 62/457.4 |
| 2006/0242990 | A1* | 11/2006 | Kao | ..... | 62/457.4 |
| 2009/0277211 | A1* | 11/2009 | Afolabi | ..... | 62/457.2 |

* cited by examiner

*Primary Examiner* — David Teitelbaum

(57) ABSTRACT

A bucket assembly includes an outer bucket with an elongated slot, an inner bucket with an elongated slot, and an insert with a cooling agent that keeps a liquid in a beverage container cold. The slot in the outer bucket aligns with the slot in the inner bucket. These slots receive a handle of the beverage container.

18 Claims, 2 Drawing Sheets

BUCKET ASSEMBLY FOR A BEVERAGE CONTAINER

BACKGROUND

Bars, restaurants, and other businesses that sell food and drinks often place cold beverages in pitchers that are sold to customers. Unfortunately, the beverages in the pitchers rapidly warm before the beverages are consumed. Ice can be placed inside the beverage (such as soda or beer), but as the ice melts it dilutes the beverage and negatively affects the taste.

Businesses that sell cold beverages in pitchers and other containers endeavor to keep the beverages from warming before the beverages are consumed.

SUMMARY

One example embodiment is a bucket assembly that includes a bucket with a slot and an insert with a space between oppositely disposed ends. The space aligns with the slot of the bucket and receives a handle of a beverage container that holds a liquid when the beverage container is in the bucket. The insert removably engages with the bucket and includes a cooling agent to maintain the liquid in the beverage container cold.

Other example embodiments and variations of these embodiments are shown and taught in the accompanying drawings and detailed description.

DETAILED DESCRIPTION

Figure 1A:
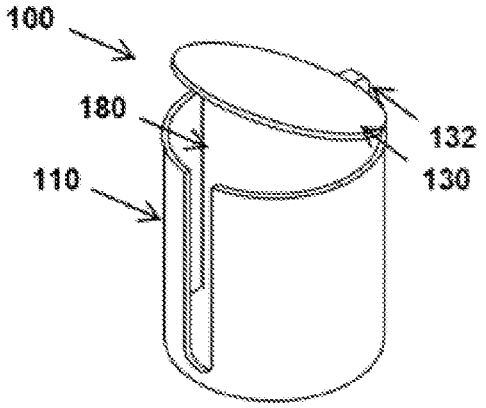
FIG. 1A is a perspective view of a bucket assembly in accordance with an example embodiment of the invention.
Figure 1B:
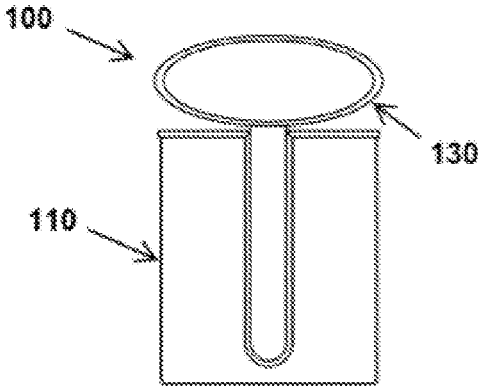
FIG. 1B is a side view of the bucket assembly of FIG. 1A in accordance with an example embodiment of the invention.
Figure 2A:
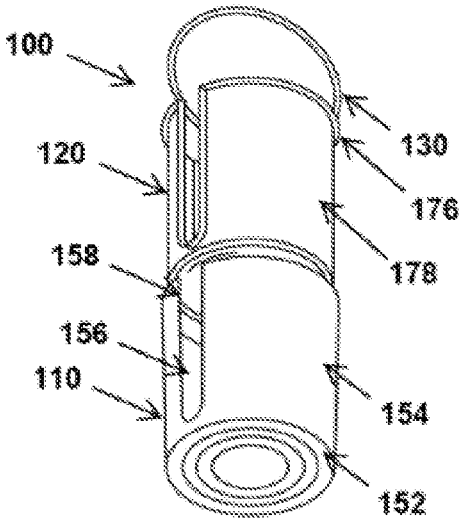
FIG. 2A is an exploded view of the bucket assembly in accordance with an example embodiment of the invention.
Figure 2B:
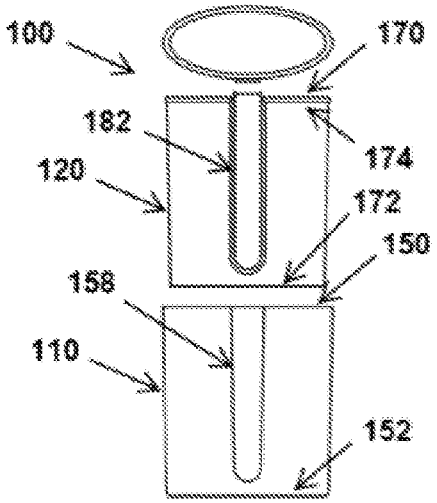
FIG. 2B is a side view of the bucket assembly of FIG. 2A in accordance with an example embodiment of the invention.

Example embodiments include a bucket assembly that holds beverages and provides a housing that maintains the beverages cold.

One example embodiment includes two interlocking buckets (an inner bucket and an outer bucket) and an insert that inserts into and engages with one of the buckets. A beverage container can be placed into the inner bucket to contact the insert. The insert is filled with a cooling agent (such as ice, cold water, and/or another substance) to maintain beverages in the beverage container cold.

The insert keeps water and ice sealed inside of the bucket assembly and prevents contaminants from contaminating the water and ice sealed therein. Furthermore, the two interlocking buckets include an air-gap, air-lock space, or insulation between them. This space reduces or eliminates condensation from forming on an exterior surface of the outer bucket and also insulates the ice or cooling agent that is located inside of the inner bucket. As such, the bucket assembly reduces and slows the melting process of the ice located inside of the inner bucket and assists in maintaining beverages in the beverage container cold.

When a beverage container is positioned inside the bucket assembly, the beverage container remains in contact with the ice and/or water located in the insert and thus remains cold. Furthermore, components of the bucket assembly (such as the two buckets and the insert) are separable and removable from each other. As such, these components can be readily cleaned, repaired, and replaced if one of them becomes damaged.

The bucket assembly saves bars, restaurants, and other businesses that sell food and drinks money since ice or other cooling agents used to cool beverages lasts longer, remains confined inside the bucket (e.g., does not spill from the bucket), and remains free from contaminates. As such, ice provided in the insert and the insert itself can be safely reused. Furthermore, beverages in the beverage container remain cold longer and are not subject to warming rapidly after being sold to customers.

FIGS. 1A, 1B, 2A, and 2B show a bucket assembly 100 in accordance with an example embodiment of the invention. The bucket assembly 100 includes an outer bucket 110 and an inner bucket 120 with a lid 130 that removably connects to the inner bucket 120 via a hinge 132.

The outer bucket 110 has a cylindrical shape or truncated cone shape with an open top 150 and a flat bottom 152. A body 154 of the outer bucket includes an outer surface and an inner surface that define a volume or space 156 into which the inner bucket 120 is positioned. The outer bucket 110 includes an elongated opening, channel, or slot 158 that extends from the top 150 to or toward the flat bottom 152.

The inner bucket 120 has a cylindrical shape or truncated cone shape with an open top 170 and a flat bottom 172. A top of the inner bucket includes a rim 174 with one or more locking mechanisms 176 that engage the top surface of the outer bucket 110. A body 178 of the inner bucket includes an outer surface and an inner surface that define a volume or space 180 that receives a foldable insert (shown in FIGS. 4-6) and a beverage container (shown in FIGS. 5-6). This volume or space 180 thus holds a beverage container and an insert with water, ice, or other liquids and material to keep beverages cold when such beverages are located in the beverage container. The inner bucket 120 includes an elongated opening, channel, or slot 182 that extends from the rim 174 to or toward the flat bottom 172.

The outer bucket 110 and the inner bucket 120 have similar shapes with the inner bucket 120 having a smaller size than the outer bucket 110. As such, the body 178 of the inner bucket 120 can fit into or inside of the volume or space 156 of the outer bucket 110. When the inner bucket 120 fits inside the outer bucket 110, the slot 182 of the inner bucket aligns with the slot 158 of the outer bucket.

When the inner bucket 120 fits within the volume or space 156 of the outer bucket 110, the locking mechanism 176 of the inner bucket 120 engages the rim or top portion of the outer bucket 110 such that the inner bucket 120 locks to or connects with the outer bucket 110. By way of example, this locking mechanism includes, but is not limited to snap-fit connections, twist-lock connections, threaded connections, tongue and groove connections, and other type of mechanical connections.

Figure 3A:
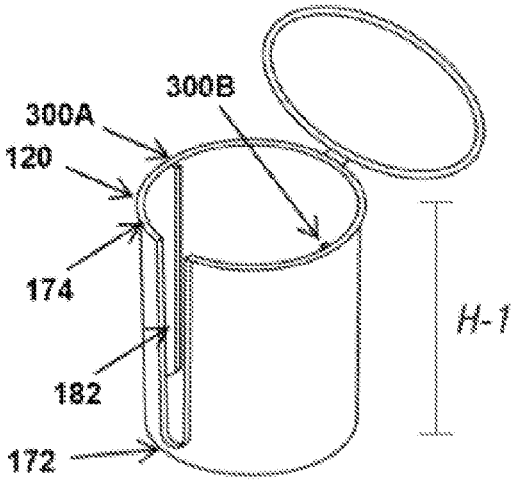
FIG. 3A is a perspective view of an inner bucket of the bucket assembly in accordance with an example embodiment of the invention.
Figure 3B:
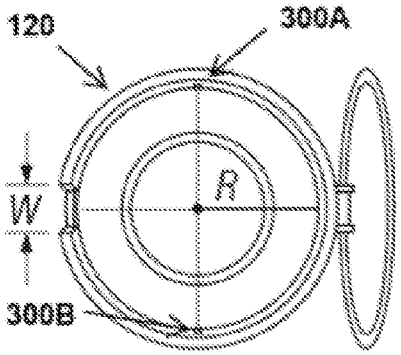
FIG. 3B is a top view of the inner bucket of FIG. 3A in accordance with an example embodiment of the invention.
Figure 4:
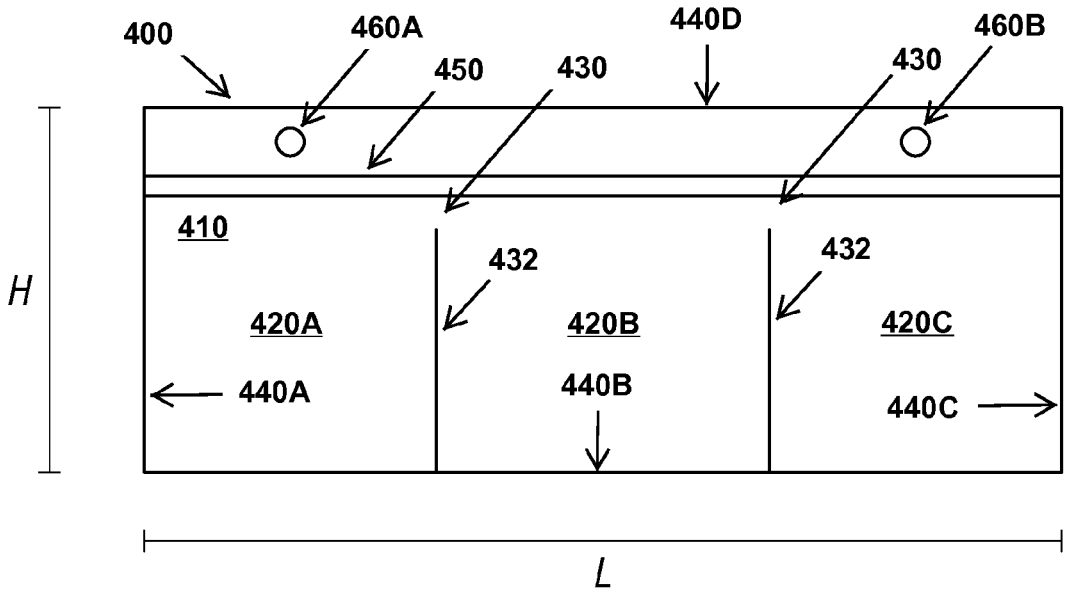
FIG. 4 is a plan view of an insert of the bucket assembly in accordance with an example embodiment of the invention.

FIGS. 3A and 3B shown the inner bucket 120 includes one or more connection mechanisms 300A and 300B that engage with the insert (see insert 400 shown in FIG. 4). By way of example, the connection mechanism includes, but is not limited to, one or more of a protrusion, a channel, a hook, a slot, a connector, threads, a fastener, and a clasp. The connection mechanisms 300A and 300B are located adjacent to the rim 174 of the inner bucket.

As shown in FIGS. 3A and 3B, the inner bucket 120 has a height H-1 and a radius R. The slot 182 has a length equal to or less than the height H-1 and has a width W. By way of example, the slot 182 extends from the rim 174 toward the bottom 172.

FIG. 4 shows an insert 400 with an elongated rectangular shape that includes a body 410 with one or more chambers or cavities 420A, 420B, and 420C. These chambers can be separate from each other such that water, ice, or other liquids cannot pass from one chamber to another chamber. For example, one or more heat seals separate the chambers. Alternatively, these chambers can include a passage way 430 that allows liquids and/or ice to pass from one chamber to another chamber. Heat seals 432 extend from a bottom of the insert toward the passage way 430 and provide a barrier that separates portions of the chambers from each other.

The insert 400 is sealed or closed on three of its sides (shown as side 440A, 440B, and 440C). A fourth side 440D opens to enable ice and/or liquids to be placed inside of the insert. This fourth side 440D includes one or more seals or closures 450. When the seal 450 is closed, then ice and/or liquid trapped in the insert cannot escape or leak (e.g., cannot escape from the chambers or cavities 420A, 420B, and 420C). By way of example, this seal 450 can include one or more a zip-lock mechanisms.

The fourth side 440D includes one or more connectors (shown as holes 460A and 460B) that extend through the body of the 410 of the insert above the seal 450. These connectors engage with the connection mechanisms 300A and 300B on the inner bucket 120 so the insert 400 hangs from, engages with, and/or is supported by the inner bucket. By way of example, the connectors are holes 460A and 460B that receive protrusions from the connection mechanisms 300A and 300B, respectively. When the connectors of the insert connect or engage with the connectors of the inner bucket, the insert hangs from and/or is supported by the inner bucket.

The connectors of the insert are not limited to being holes. By way of example, these connectors can be male protrusions that engage female receptacles on the inner bucket. Alternatively, the connectors of the insert can be Velcro, buttons, or fasteners that removably snap or engage to the connectors on the inner bucket.

Looking to FIGS. 3A, 3B and 4, the insert 400 has a length L and a height H. The height of the insert 400 is equal to or less than the height H-1 of the inner bucket. Further, the length L of the insert 400 is equal to or less than a circumference of the inner bucket minus the width of the slot 182 (i.e., $2\pi R-W$, where $\pi$ is pi equal to 3.14).

The insert 400 can be formed of plastic or polymer and can have a strong rigid body that does not bend or flex. For example, the insert is formed of curved or rounded sections that emulate a shape of the inner bucket. Alternatively, the insert can have a flexible, foldable body that bends. For example, a flexible body can change shapes and wrap around or conform to a shape of a beverage container inserted into the inner bucket. For instance, the insert is formed from a flexible polymer or plastic bag with one or more zip locks along one open end 440D.

Furthermore, the insert is watertight and/or waterproof such that water or another liquid (such as a liquid used to cool beverages) cannot escape through or pass into or out of the insert. For example, when the insert is filled with cold water and ice, this water cannot seep through or escape through the body of the insert. Furthermore, the insert can have different shapes, such as a polygonal shape, a circular shape, a rectangular shape, etc.

Figure 5:
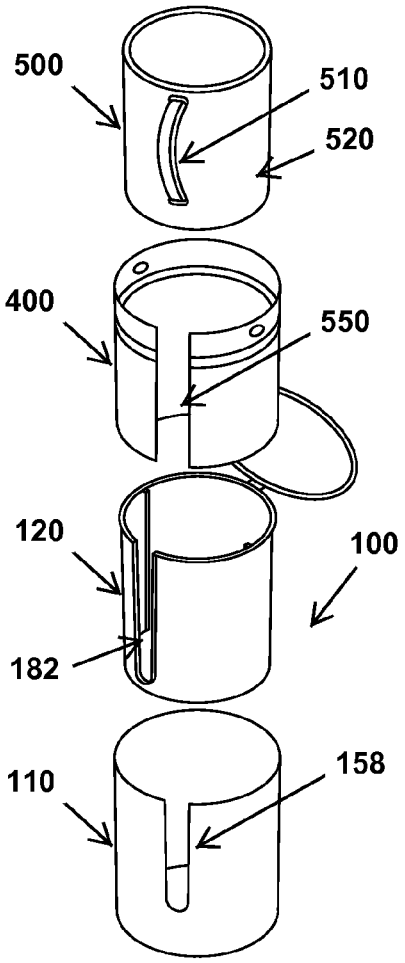
FIG. 5 is an exploded view of the bucket assembly, the insert, and a beverage container in accordance with an example embodiment of the invention.
Figure 6:
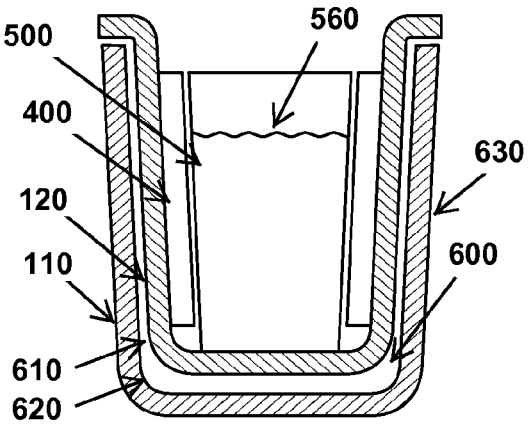
FIG. 6 is a cross-sectional side view of the bucket assembly, the insert, and the beverage container assembled together in accordance with an example embodiment of the invention.

FIGS. 5 and 6 show how the bucket assembly 100, the insert 400, and a beverage container 500 engage or connect together. The beverage container 500 includes a handle 510 that extends outwardly from a body 520 of the beverage container. By way of example, the beverage container is a container, with or without a handle, that holds and pour liquids. For instance, the beverage container is a glass, a mug, or a pitcher for holding cold liquids (such as beer, water, soda, etc.).

The insert 400 has a cylindrical shape or configuration with open ends. A space or gap 550 extends along the height of the insert 400, and this space or gap 550 aligns with the slots 158 and 182. The inner bucket 120 and the insert 400 fit inside the outer bucket 110 such that the slot of the 182 of the inner bucket 120 and the space or gap 550 of the insert 400 align with the slot 158 of the outer bucket 110. These openings receive the handle 510 of the beverage container 500 that removable fits inside of the inner and outer buckets. The insert is filled with water, ice, and or liquids to keep beverages 560 inside the beverage container cold. When the beverage container 500 is located inside the buckets, the insert 500 surrounds the exterior surface of the beverage container.

The space or gap 550 forms between two oppositely disposed ends of the insert 400. This space or gap has an elongated rectangular configuration and emulates a size and/or shape of the slots of the inner and outer buckets.

In an example embodiment, the insert folds or bends to emulate a shape of the inner bucket. The insert is positioned along an interior wall or surface of the inner bucket such that the insert wraps around an exterior surface of the beverage container in order to keep liquid in the beverage container cold.

The inner bucket engages with the outer bucket such that these two buckets are removable from each other. Alternatively, these two buckets can be integrally formed. For example, the two buckets are not separable but formed as a single unitary bucket.

FIG. 6 shows an air gap, air-lock space, or insulation 600 extends between an outer surface 610 of the inner bucket 120 and an inner surface 620 of the outer bucket 110. This air-lock space 600 reduces condensation on an outer surface 630 of the outer bucket 110 when the insert 400 includes ice or another cooling liquid or material. For instance, when the insert 400 is filled with ice and/or water, the air-lock space provides insulation or an air barrier that assists in reducing the transfer or heat or cold between the inner and outer buckets.

The insert is not limited to a particular configuration. For example, the insert can include a closed bottom end that seats against or engages with the bottom of the inner bucket. In this example embodiment, a bottom of the beverage container seats against or engages with cold liquid and/or ice in the insert when the beverage insert is inserted into the inner bucket. Furthermore, the insert can be made with multiple sections that connect together (e.g., sections that fold and connect together along a heat seal).

Additionally, the insert is not limited to having an open side. For example, the insert can be a closed plastic or polymer container that is filled with a cooling liquid or agent. For instance, the insert is a re-usable cold pack that is re-freezable or ice pack that contains a liquid or gel that is placed in a refrigerator or freezer.

The slots on the inner and the outer bucket can have various shapes and sizes and depend, for example, on a shape and/or size of a handle of the beverage container. For instance, the slots have an elongated straight or tapering rectangular configuration with a square or rounded end. Further yet, the slots commence at the open ends of the buckets and extend downwardly toward or to the bottom. Additionally, the buckets can be made without the slots or with multiple slots (e.g., to accommodate a pitcher with two handles).

The lid can be provided with a seal (such as a rubber or polymer seal) to engage a top of one or more of the buckets in order to maintain liquids in the beverage container cold. The lid fits over openings to the inner and outer buckets to slow warming of the cooling agent located inside of the insert. Additionally, the bucket assembly can be made without a lid.

The bucket assembly can be made from one or more of plastics, polymers, metals, steel, composite materials, and wood. Furthermore, example embodiments show a lid connected to the inner bucket. Alternatively, the lid can connect to the outer bucket, or the bucket assembly can be provided without a lid.

One skilled in the art will appreciate, upon reading this disclosure, numerous modifications and variations to example embodiments. The appended claims cover such modifications and variations.

What is claimed is:

1. A bucket assembly, comprising:

an outer bucket that includes an elongated slot;

an inner bucket that includes an elongated slot and that fits inside of and removably engages with the outer bucket such that the slot of the inner bucket aligns with the slot of the outer bucket; and a cylindrically-shaped insert that includes a space formed between oppositely disposed ends and that surrounds an interior surface of the inner bucket such that the space of the insert aligns with the slot of the inner bucket and the slot of the outer bucket, wherein the interior surface of the inner bucket and the insert have a size and shape to receive a beverage container that holds a liquid, wherein the insert includes a cooling agent to maintain the liquid in the beverage container cold wherein the insert includes an insert connector and the inner bucket includes an inner bucket connector such that the insert connector locks to the inner bucket connector using one of a snap-fit connection, a twist-lock connection, a threaded connection, and a tongue and groove connection.

2. The bucket assembly of claim 1, wherein the insert is pliable, formed of a polymer, and includes a zip-lock seal to maintain the cooling agent enclosed in the insert.

3. The bucket assembly of claim 1, wherein the slot of the inner bucket, the slot of the outer bucket, and the space of the insert have an elongated rectangular shape that receives a handle on the beverage container.

4. The bucket assembly of claim 1, wherein the insert wraps around an exterior surface of the beverage container and is filled with water and ice to keep the liquid cold.

5. The bucket assembly of claim 1, wherein the insert includes two holes and the inner bucket includes two protrusions that fit into the two holes such that the insert hangs inside of the inner bucket.

6. The bucket assembly of claim 1, wherein the inner bucket engages the outer bucket to provide an air-lock space therebetween that reduces condensation on an outer surface of the outer bucket when the insert includes the cooling agent.

7. The bucket assembly of claim 1, wherein the outer bucket includes an outer bucket rim, the inner bucket includes an inner bucket rim, and the outer bucket rim removably engages the inner bucket rim with one of a snap-fit connection and a threaded connection.

8. The bucket assembly of claim 1, wherein the inner bucket includes a lid that covers openings to the inner and outer buckets in order to slow warming of the cooling agent located in the insert.

9. A bucket assembly, comprising:

an outer bucket with a body and an elongated slot that extends through the body of the outer bucket;

an inner bucket with a body that receives a beverage container with a liquid, that includes an elongated slot that extends through the body of the inner bucket, and that fits inside of the outer bucket such that the slot of the inner bucket aligns with the slot of the outer bucket; and an insert that folds into a cylindrical shape to have a space formed between oppositely disposed ends such that the space of the insert aligns with the slot of the inner bucket and the slot of the outer bucket, wherein the insert removably engages with an interior surface of the inner bucket and includes a cooling agent to maintain the liquid in the beverage container cold wherein the insert includes an insert connector and the inner bucket includes an inner bucket connector such that the insert connector locks to the inner bucket connector using one of a snap-fit connection, a twist-lock connection, a threaded connection, and a tongue and groove connection.

10. The bucket assembly of claim 9, wherein the insert is closed at three ends, is openable at one end to receive the cooling agent, and has three chambers that are separated with heat seals.

11. The bucket assembly of claim 9, wherein the inner bucket engages the outer bucket to provide an air-lock space that exists between an outside surface of the inner bucket and an inside surface of the outer bucket such that the air-lock space reduces condensation on an outer surface of the outer bucket when the beverage container includes a cold liquid.

12. The bucket assembly of claim 9, wherein the inner bucket, the outer bucket, and the insert are removable from each other.

13. The bucket assembly of claim 9, wherein the space of the insert, the slot of the inner bucket, and the slot of the outer bucket have an elongated rectangular shape sized to receive a handle on a body of the beverage container.

14. The bucket assembly of claim 9, wherein the insert is a plastic bag that includes a double zip lock to seal water and ice inside of the plastic bag.

15. A bucket assembly, comprising:

an outer bucket that includes a body having an elongated rectangular slot that extends through the body of the outer bucket from a top open end toward a bottom closed end;

an inner bucket that includes a body having an elongated rectangular slot that extends through the body of the inner bucket from a top open end toward a bottom closed end and that receives and holds a beverage container with a liquid such that the elongated rectangular slot of the inner bucket aligns with the elongated rectangular slot of the outer bucket; and an insert with a cylindrical shape having a space formed between oppositely disposed ends such that the space of the insert aligns with the elongated rectangular slot of the inner bucket and the elongated rectangular slot of the outer bucket, wherein the insert fits inside the inner bucket and includes a cooling agent to maintain the liquid in the beverage container cold wherein the insert includes an insert connector and the inner bucket includes an inner bucket connector such that the insert connector locks to the inner bucket connector using one of a snap-fit connection, a twist-lock connection, a threaded connection, and a tongue and groove connection.

16. The bucket assembly of claim 15, wherein the bucket assembly includes an outer surface, an inner surface, and an air-lock space that exists between the outer and inner surfaces in order to reduce condensation on the outer surface when the bucket assembly houses the beverage container with a cold liquid.

17. The bucket assembly of claim 15, wherein the insert has three chambers that are separated from each other with one or more heat seals.

18. The bucket assembly of claim 15, wherein the insert is a cold pack that is re-freezable.

* * * * *